US008907530B1

(12) United States Patent
Saxton

(10) Patent No.: US 8,907,530 B1
(45) Date of Patent: Dec. 9, 2014

(54) SYSTEM FOR REDUCING POWER CONSUMPTION IN A STRUCTURE

(76) Inventor: Paul Saxton, Sioux Falls, SD (US)

( * ) Notice: Subject to any disclaimer, the term of this patent is extended or adjusted under 35 U.S.C. 154(b) by 285 days.

(21) Appl. No.: 13/288,727

(22) Filed: Nov. 3, 2011

(51) Int. Cl.
*G05F 1/14* (2006.01)

(52) U.S. Cl.
USPC ..... 307/153; 315/276

(58) Field of Classification Search
USPC ..... 315/117, 144, 278, 290, 291, 293, 297, 315/307, 309, 360, 276; 363/21.01, 21.07, 363/86, 89, 97, 127, 137; 307/29, 20, 68, 307/37–39, 235, 237, 153; 700/12, 27, 298
See application file for complete search history.

(56) References Cited

U.S. PATENT DOCUMENTS 4,189,644 A * 2/1980 Schubert et al. ..... 250/381
4,402,059 A * 8/1983 Kennon et al. ..... 713/300
4,819,180 A * 4/1989 Hedman et al. ..... 700/291
6,191,568 B1 * 2/2001 Poletti ..... 323/268
6,624,532 B1 * 9/2003 Davidow et al. ..... 307/39
6,906,476 B1 * 6/2005 Beatenbough et al. ..... 315/276

* cited by examiner

*Primary Examiner* — Rajnikant Patel
(74) *Attorney, Agent, or Firm* — Jeffrey A. Proehl; Woods, Fuller, Shultz & Smith, P.C.

(57) ABSTRACT

A local voltage adjustment apparatus for connection to a power utilization meter comprising a line in for connection to the meter, a line out, a transformer connected to the line in and line out. The transformer has an adjustable voltage conversion ratio of an output voltage level to an input voltage level. The transformer may comprise an autotransformer. A control device is in electrical communication with the line out to sense the level of the output voltage, and is configured to adjust the voltage conversion ratio of the transformer based upon the output voltage level. The control device is configured to select the voltage conversion ratio for the transformer that reduces the output voltage level from the input voltage level to a voltage in a target voltage range. The target voltage range may be from approximately 100 volts to approximately 112 volts.

18 Claims, 4 Drawing Sheets

SYSTEM FOR REDUCING POWER CONSUMPTION IN A STRUCTURE

BACKGROUND

1. Field

The present disclosure relates to electrical energy management system and more particularly pertains to a new system for reducing electrical power consumption in a structure and thereby reducing the electrical power costs for the power consumer.

2. Description of the Prior Art

The electrical power supply system, sometimes referred to as the power grid, includes power generation facilities and power transmission lines that distribute the electrical power from the generation facilities to the ultimate power consumer, which is typically located in a structure such as a home or business. Between the power generation facility and the structure the characteristics of the power supplied may be adjusted several times, typically stepping up the voltage level for longer distance transmission stages and then stepping down the voltage level at the end of the long distance transmission stages to a level that is more compatible with the electrically-powered devices that are typically utilized in a home or business structure.

However, due to losses in the last stage of electrical transmission lines which are connected directly to the structure and the variation in the physical proximity of the structure to the closest transformer, the voltage of the power delivered by the system to the structure is not uniform between structures being fed power from the same transformer, but instead falls within a range of voltage levels that are generally acceptable for powering the electrically powered devices in the structure. This range of voltage levels over which an electrical device such as an appliance is designed to operate is typically a range of approximately plus or minus 10% of approximately 115 volts, or between approximately 103 volts and approximately 127 volts, and thus this is the range in which the voltage of the power supplied to the structure must fall as delivered by the power utility to the structure. Although the voltages within the range are considered acceptable for devices utilized in homes and businesses, and the devices are designed to operate on voltages in the acceptable range, many devices will typically operate more efficiently at a more specific voltage level, or a narrower range of voltage levels, than the acceptable voltage level range. Often, operation of the devices at the more specific voltage level or narrower range of voltage levels will also tend to extend the operating life of the device, as operating at voltage levels above or below the desirable voltage level tends to decrease the operating life due to, for example, operating at lower temperatures.

SUMMARY

In view of the foregoing, the present disclosure describes a new system for reducing power consumption in a structure which may be utilized for reducing the electrical power costs for the power consumer by bringing the voltage of power supplied to electrical devices in the structure to a lower level than may be supplied by the electrical power utility.

In one aspect, the present disclosure relates to a local voltage adjustment apparatus for connection to a power utilization meter of an electrical power utility for a structure providing electrical power at a utility supply voltage through a main supply line into the structure. The apparatus may comprise a line in for connection to the main supply line such that electrical power on the line in has an input voltage substantially equal to the utility supply voltage, and a line out with electrical power on the line out having an output voltage for connection to multiple circuits of the structure to supply electrical power to multiple devices connected to the multiple circuits. The apparatus may also comprise a transformer connected to the line in and the line out, with the transformer having an adjustable voltage conversion ratio of a level of the output voltage to a level of the input voltage. The transformer may comprise an autotransformer. The apparatus may also comprise a control device in electrical communication with the line out to sense the level of the output voltage. The control device may be configured to adjust the voltage conversion ratio of the transformer based upon one level selected from the group comprising the level of the input voltage of the transformer and the level of the output voltage. The control device may be configured to select the voltage conversion ratio for the transformer that reduces the level of the output voltage from the level of the input voltage to a voltage in a target voltage range. The target voltage range may be from approximately 100 volts to approximately 112 volts.

In another aspect, the disclosure relates to a local voltage adjustment system for a structure that may comprise a power utilization meter for measuring power flowing through the meter from an electrical power utility at a utility supply voltage, with the meter having an outlet. The system may also comprise a main supply line from the outlet of the meter and carrying power at the utility supply voltage. The system may further comprise a voltage adjustment apparatus connected to the main circuit breaker element through the main supply line and having a line in and a line out so that electrical power on the line in has an input voltage substantially equal to the utility supply voltage and electrical power on the line out has an output voltage. The voltage adjustment apparatus may comprise a transformer having an adjustable voltage conversion ratio of a level of the output voltage to a level of the input voltage, and a control device in electrical communication with the line in to sense the level of the input voltage and in electrical communication with the line out to sense the level of the output voltage. The control device may be configured to adjust the voltage conversion ratio of the transformer based upon one level selected from the group comprising the level of the input voltage of the transformer and the level of the output voltage. The control device may be configured to select the voltage conversion ratio that reduces the level of the output voltage from the level of the input voltage to a voltage in a target voltage range. The system may also include a sub panel element connected to the voltage adjustment apparatus to receive electrical power from the apparatus at the output voltage, and the sub panel element may be connected to a plurality of electrical circuits of the structure, each of the circuits receiving electrical power at the output voltage.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
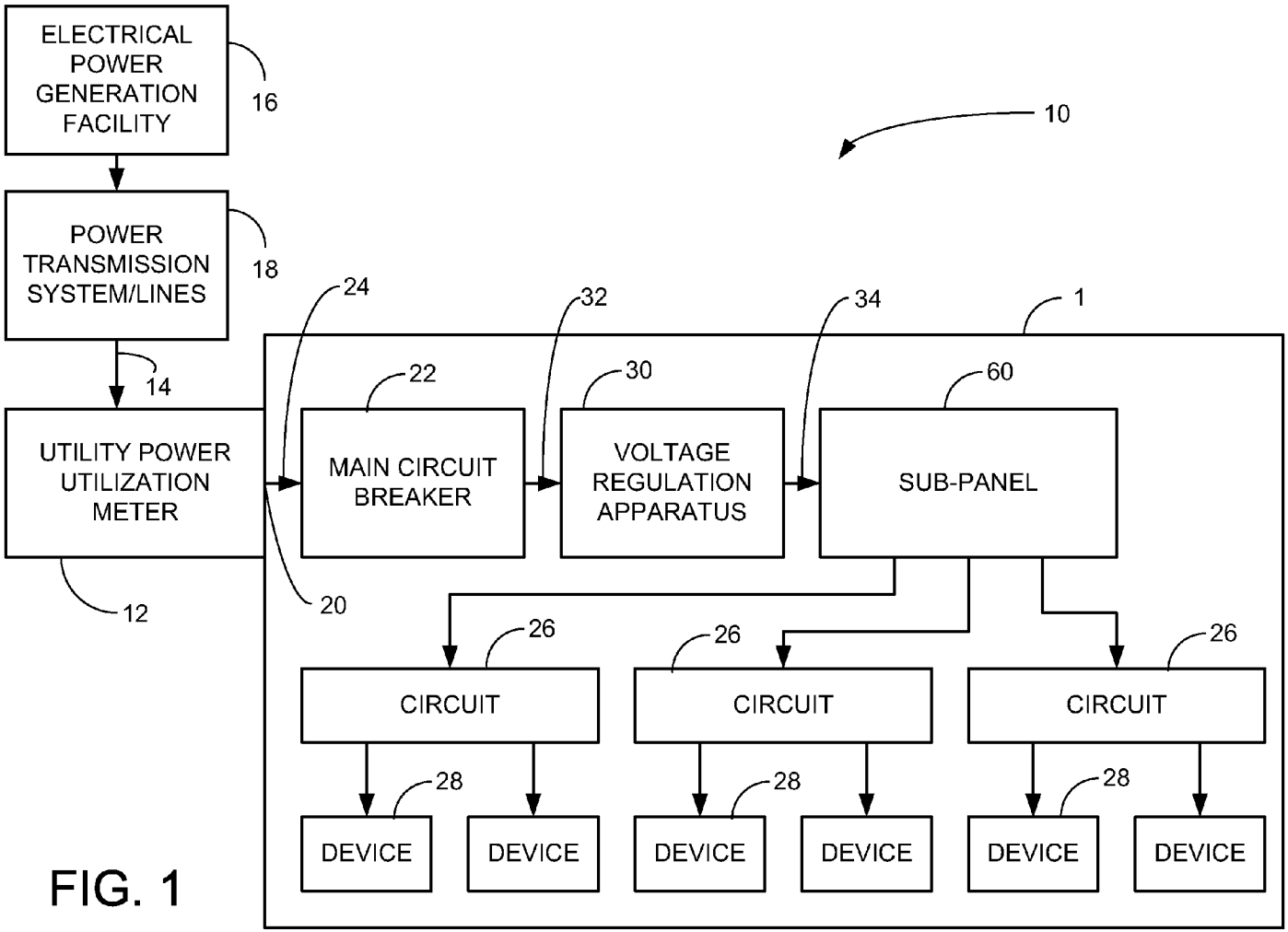
FIG. 1 is a schematic diagram of a new system according to the present disclosure.
Figure 2:
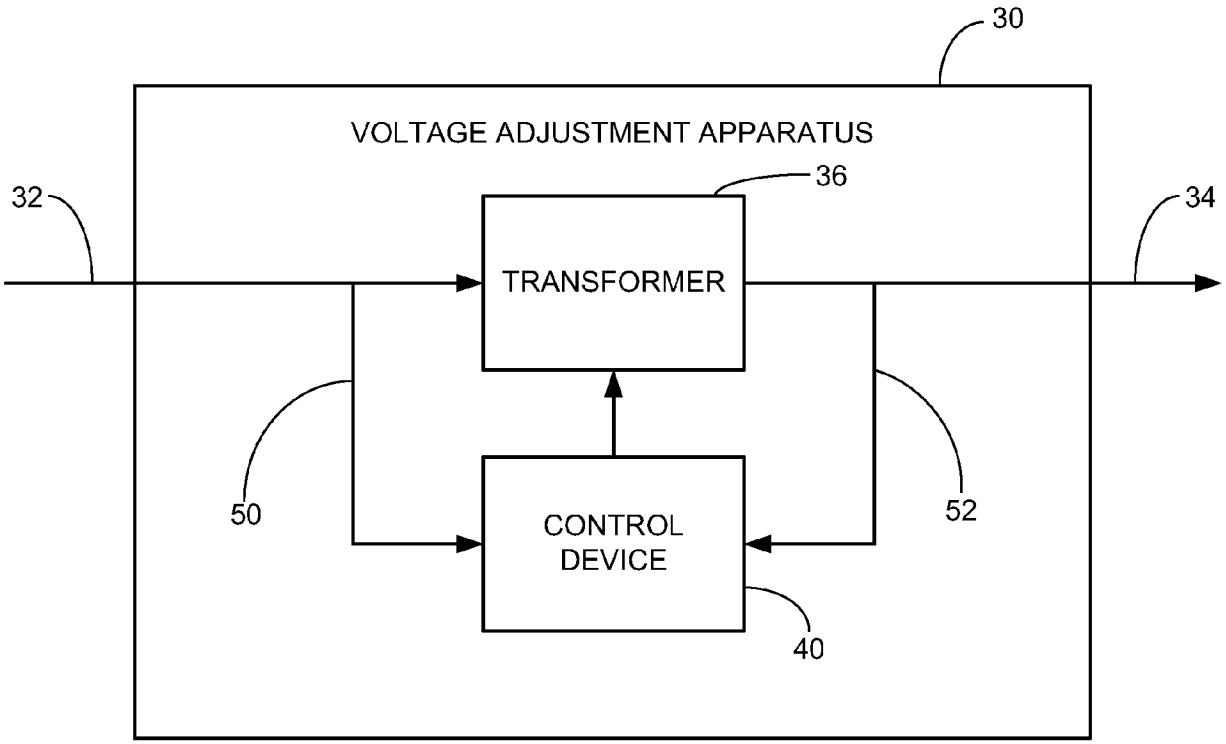
FIG. 2 is a schematic diagram of the voltage adjustment apparatus of the system, according to an illustrative embodiment.
Figure 3:
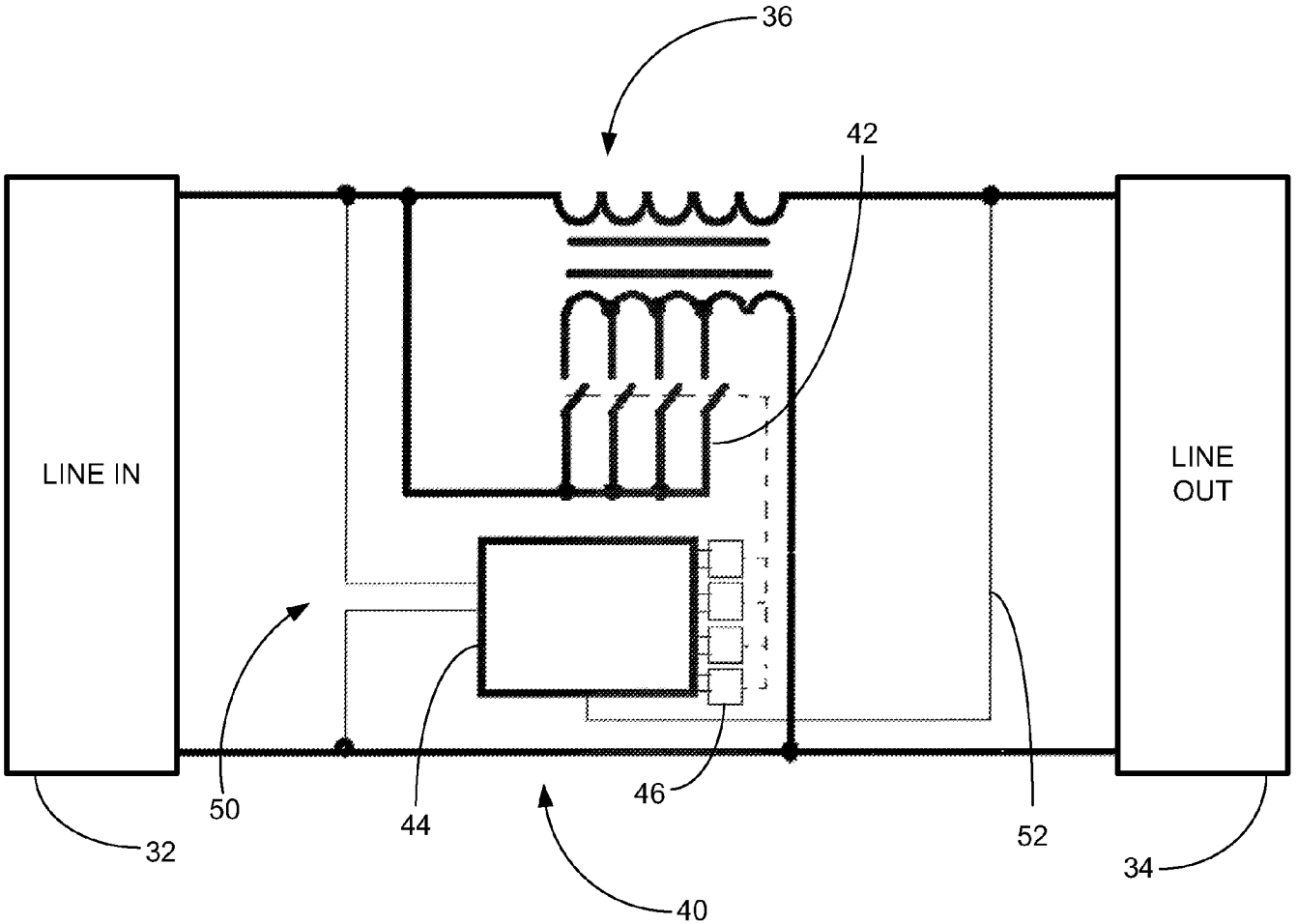
FIG. 3 is a schematic diagram of the voltage adjustment apparatus in greater detail and according to an illustrative embodiment.

With reference now to the drawings, and in particular to FIGS. 1 through 4 thereof, a new system for reducing power consumption in a structure embodying the principles and concepts of the disclosed subject matter will be described.

The applicant has recognized that electrical power is wasted by the supply (and the corresponding usage) of electrical power by power consumers in a structure at voltage levels that are higher than necessary to power most of the devices typically utilized in the structure. This supply of power at voltage levels higher than necessary is a result of the need to provide all power consumers at the last stage of the power distribution grid with a higher than necessary voltage level (at the last transformer) so that even with voltage losses in the transmission lines the lowest voltage seen by a structure will be above a lowest acceptable level.

The applicant have also recognized that adjusting the voltage of the electrical power supplied to the structure at the structure to more desirable voltage level decreases the amount of power actually used by the consumer in the structure since in almost every case adjusting the voltage will entail reducing the voltage level from the voltage level of power supplied to the power utilization meter, which typically falls within a broad range, to a target voltage that is typically less than the range of acceptable voltages for power supplied to structures receiving the electrical service. In some preferred implementations, the voltage level is reduced from the nominal 120 volt (and 240 volt for circuits utilizing both legs of the service drop) level to a target voltage level in the range of between approximately 104 volts (and approximately 208 volts across both legs) and approximately 110 volts (and approximately 220 volts), with approximately 109 volts being one of the most preferable target voltages. As power is the product of voltage and current, a reduction in the voltage reduces the amount of power used and thus the overall cost of power used. Further, the applicant has recognized that this has the benefit of potentially extending the life of many of the devices utilized in a structure by reducing the heat and related stresses on the components of the devices utilized in the structure.

In one aspect of the disclosure, a local voltage regulation system 10 for a structure 1 will be described. As noted, the structure 1 is typically a building serving the purpose of a dwelling, such as a single family house or a multifamily housing, or a business, such as a retail store, although it is believed that the elements of the system find greatest benefit in dwellings. The structure 1 as described here may not include industrial electrical consumers such as a factories, which may typically utilize a transformer on site to adjust power to one or more voltage levels needed to operate various devices of the facility.

The system 10 may include elements of a conventional electrical service or service drop, such as a power utilization meter 12 for measuring power flowing through the meter. The meter 12 is typically the means by which the electrical power usage by the structure, and more specifically the devices in the structure, is measured for determining billing for energy usage. The meter 12 has a meter input 14 connected to the power generation facility 16 of an electrical power utility through power supply transmission wires 18 and other facilities forming the electrical power supply grid. The meter 12 also has a meter output 20 carrying power that is measured by the meter. The characteristics of the power at the meter output are considered the source characteristics of the power supplied to the structure, including a utility supply voltage. Commonly, the meter 12 is mounted on the outside of the structure 1 although this is not critical to the operation of the system. Typically, the meter belongs to and is maintained by the electrical power utility, and elements of the power supply system beyond the meter are the responsibility of the owner or occupant of the structure, although again this is not critical to the operation of the system.

The system 10 may also include a main circuit breaker element 22 that is typically connected to the meter 12 through the output 20 for breaking or interrupting connection of the circuits of the structure to the meter 12 due to, for example, unsafe operating conditions in the structure or the need to disconnect the circuits from the electrical power supply grid. For the purposes of this description, the main circuit breaker element 22 may also comprise a fusible link or element and not only a circuit breaker that may be reset. The main circuit breaker element 22 may be positioned in a main circuit breaker panel that may be situated in the structure, although this is not critical.

A main supply line 24 may extend from the meter 12 to the main circuit breaker element 22 as an output of the element 22 carrying power at the utility supply voltage. In many conventional installations, the main supply line 24 may be incorporated into the main circuit breaker panel with the main breaker element, and also with a plurality of secondary circuit breakers that are each associated with one of the plurality of electrical circuits 26 of the structure. Electrical devices 28 utilizing the electrical power from the system are connected to the plurality of circuits 26.

A voltage adjustment apparatus 30 may be integrated into the system 10, such as by connection to the main circuit breaker element 22 through the main supply line 24, and prior to the circuits 26 of the structure and the devices 28. The voltage adjustment apparatus 30 may have a line in 32 and a line out 34. Electrical power on the line in 32 has an input voltage that is substantially equal to the utility supply voltage and electrical power on the line out 34 has an output voltage that is adjusted, and typically different from, the input voltage and thus the utility supply voltage.

In greater detail, the voltage adjustment apparatus 30 may comprise a transformer 36 for converting the voltage level of the input voltage to the voltage level of the output voltage. In most embodiments, the transformer 36 has an adjustable voltage conversion ratio, and not a fixed ratio, to adjust to changes in the level of the input, or utility supply, voltage and keep the level of the output voltage relatively uniform over a time period. Thus the ratio of the level of the output voltage to the level of the input voltage is variable using techniques for adjusting the ratio of the transformer that are known to those in the art. Since the ratio of the output and input voltage levels is fairly close to 1, the transformer may comprise an adjustable autotransformer, such as a buck transformer.

The voltage adjustment apparatus 30 may also include a control device 40 for controlling the ratio of the transformer 36 based upon detected levels of the input and output voltages. The control device 40 may be in electrical communication (as indicated by the line 50) with the line in 32 to the extent that the device 40 (or an associated sensor) is able to sense the level of the input voltage for determining the adjustment that needs to be made to the voltage level by the transformer to achieve an output voltage in the target range of voltages (and the control device may also be powered through this connection). The control device 40 may also be in electrical communication (as indicated by the line 52) with the line out 34 to the extent that the device 40 (or, again, an associated sensor) is able to sense the level of the output voltage for determining that the output voltage has been adjusted to a voltage level that falls in the range of target voltage levels. The control device selects a voltage conversion ratio for the transformer that will bring the level of the output voltage into a target voltage range which is less than the level of the input voltage, which is typically the utility supply voltage. In some embodiments, the target voltage range is from approximately 100 volts to approximately 112 volts (and approximately 200 volts to approximately 124 volts for circuits utilizing both legs of the supply). In some further embodiments, the target voltage range is from approximately 104 volts to approximately 110 volts (and approximately 208 volts to approximately 120 volts across both legs). In still further embodiments, the target voltage range is approximately 108 volts (and approximately 216 volts) to approximately 110 volts (and approximately 220 volts). In some ideal embodiments, the control device selects a voltage conversion ratio that results in a target output voltage on the line out 34 of approximately 109 volts (and approximately 218 volts across both legs).

The control device 40 may be connected to the transformer 36 in a manner suitable to adjust the ratio of the level of the output voltage to the level of the input voltage of the transformer. In some embodiments, the control device 40 may select one of the plurality of taps 42 on the windings of the transformer 36 to select the voltage adjustment ratio of the transformer based upon the level of the input voltage relative to the desired output voltage. In some embodiments, the control device 40 includes a microcontroller 44 to control the condition of a plurality of relays 46, with each of the relays acting on one of the taps 42 of the transformer. Illustratively, the microcontroller may comprise a Microchip 8 bit PIC16F684 microcontroller available from Microchip Technologies, 2355 West Chandler Blvd., Chandler, Ariz., USA 85224-6199. The relays may be, for example, 30 amp relays that are actuated or energized through the use of small signal NPN transistors such as 2N222 or 2N3904, although those skilled in the art may recognize equivalent elements that could also be used.

Significantly, the use of an autotransformer allows the secondary winding to be connected in series with the line out 34 (and thus the load). As a result, a failure in control by the control device 40, such as if no tap on the autotransformer is selected, does not result in loss of power at the line out 34 (and the circuits of the structure) but merely results in the line out having a voltage level that is approximately equal to the voltage at the line in 32 reduced by the voltage drop across the secondary winding due to the current drawn by the circuits (or load) of the structure connected to the line out.

The system 10 may also include a sub panel element 60 that may be connected to the voltage adjustment apparatus 30, and the line out 30 of the apparatus 30, to receive electrical power from the apparatus 30 at the output voltage. The sub panel element 60 may be connected to the plurality of electrical circuits 26 of the structure, and the devices 28 connected thereto, to provide the devices 28 with electrical power having a voltage equal to or approximately equal to the target voltage. Each of the circuits 26 receive electrical power at the output voltage, or an integer multiple of the output voltage. The devices thus receive and operate on the target voltage.

One illustrative embodiment of the voltage adjustment apparatus 30 is designed for and intended to be used for a 200 ampere electrical service, such as is found in many homes, and has bee observed to reduce the electrical power consumption of a structure up to approximately 13%, thus lowering the electrical power billing for the structure a corresponding amount.

The system 10, and more particularly, the voltage adjustment apparatus 30 is able to adjust the voltage level of the electrical power supplied to a plurality of circuits and devices of a structure, bringing the voltage level of the electrical power to a lower level than is provided at the meter 12 and that is suitable for powering most if not all types of electrical devices that might be found in the structure, without providing an excess level of voltage that is wasteful and may shorten the operating life of the device.

Figure 4:
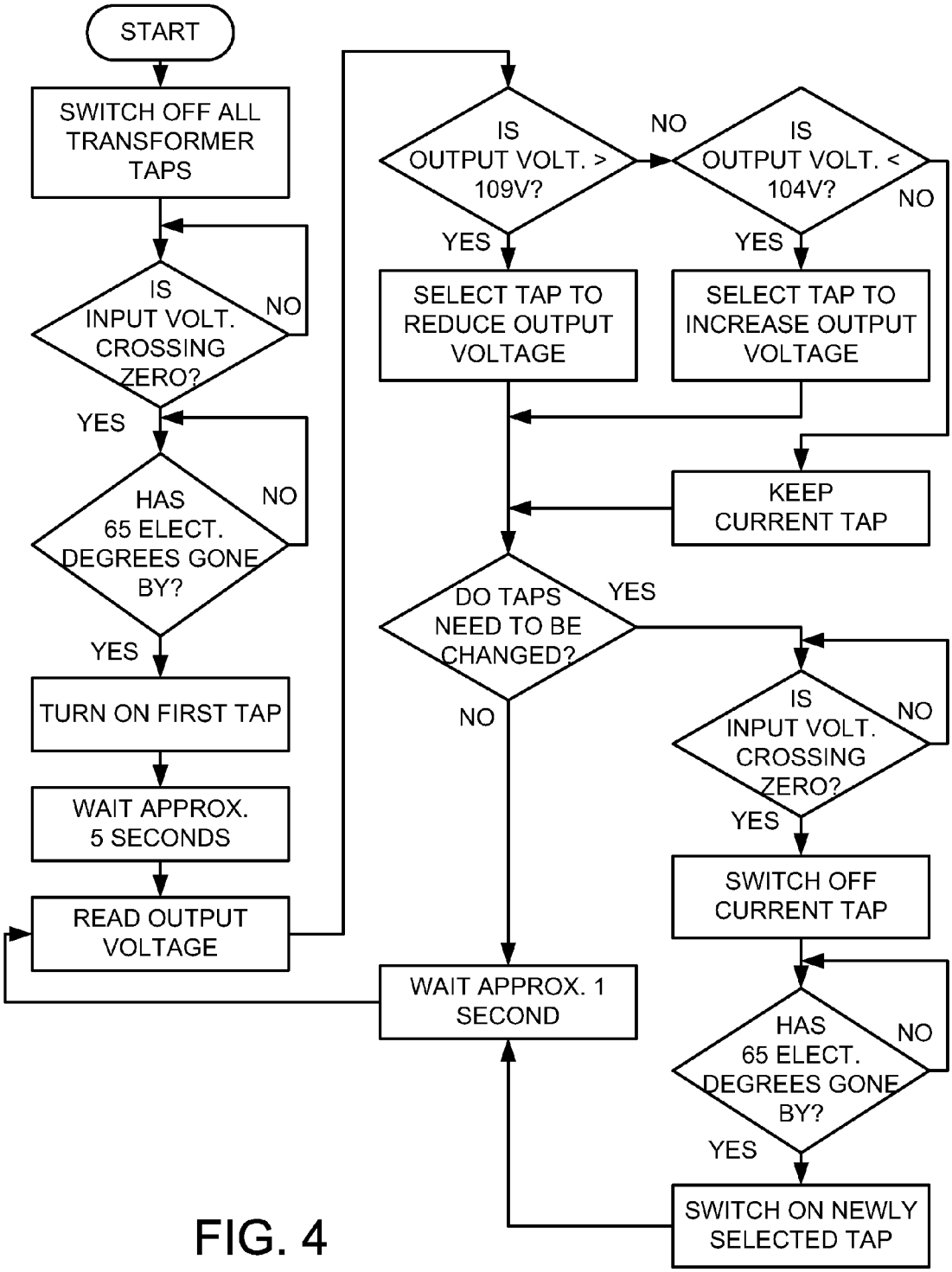
FIG. 4 is a schematic flow chart of an illustrative method of operating the voltage adjustment apparatus according to an illustrative implementation.

Illustratively, in one implementation, such as is shown in FIG. 4 of the drawings, operation of the system 10, and more specifically the apparatus 30, may begin with switching off of all of the taps of the transformer, and then determining if the sine wave of the input voltage on the line-in is currently or presently crossing zero of the voltage axis such that the voltage is momentarily zero. If it is not, the voltage on the line in continues to be tested for this condition, If it is, then it is determined if 65 electrical degrees have passed since the input voltage crossed zero. If it has not, then the determination is repeated until 65 degrees has passed. Once it is determined that 65 degrees has passed, then the first tap of the transformer is turned on, such as by activating a corresponding relay. A period of approximately 5 seconds may be allowed to pass, and then the output voltage on the line out may be checked.

If the output voltage is determined to be greater than approximately 109 volts, then another tap of the transformer is selected (but not yet energized) that will reduce the output voltage, such as a tap that energizes fewer turns of the secondary of the transformer. If the output voltage is determined to not be greater than 109 volts, then a determination is made as to whether the output voltage on the line out is less than approximately 104 volts. If the output voltage is less than approximately 104 volts, then a transformer tap is selected (but not yet energized) that will increase the output voltage, such as a tap that energizes more turns of the secondary of the transformer. If the output voltage is determined to not be less than approximately 104 volts, then the currently selected transformer tap is determined to be the correct tap for the current voltage conditions. A period of time is allowed to pass, such as approximately one second, and then the output voltage on the line out is again checked, and the voltage comparison process may be repeated.

If a new transformer tap has been selected and thus the tap needs to be changed, a determination is made whether the sine wave of the input voltage on the line-in is currently or presently crossing zero of the voltage axis such that the voltage is momentarily zero. If it is not, the voltage on the line in continues to be tested for this condition. If it is, then the currently energized transformer tap is switched off or de-energized. It is then determined if 65 electrical degrees have passed since the input voltage crossed zero. If it has not, then the determination is repeated until 65 degrees has passed. Once it is determined that 65 degrees has passed, then the newly selected transformer tap is switched on or energized. A period of time is allowed to pass, such as approximately one second, and then the output voltage on the line out is again checked, and the voltage comparison process may be repeated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A local voltage adjustment system for a structure, comprising:

a power utilization meter for measuring power flowing through the meter from an electrical power utility at a utility supply voltage, the meter having an outlet;

a main supply line from the outlet of the meter and carrying power at the utility supply voltage;

a voltage adjustment apparatus connected to the main circuit breaker element through the main supply line, the voltage adjustment apparatus having a line in and a line out, electrical power on the line in having an input voltage substantially equal to the utility supply voltage and electrical power on the line out having an output voltage, the voltage adjustment apparatus comprising:

a transformer having an adjustable voltage conversion ratio of a level of the output voltage to a level of the input voltage;

a control device in electrical communication with the line in to sense the level of the input voltage and in electrical communication with the line out to sense the level of the output voltage;

wherein the control device is configured to sense the level of the input voltage of the transformer and adjust the voltage conversion ratio of the transformer based upon the level of the input voltage, the control device being configured to select the voltage conversion ratio that reduces the level of the output voltage from the level of the input voltage to a voltage in a target voltage range; and a sub panel element connected to the voltage adjustment apparatus to receive electrical power from the apparatus at the output voltage, the sub panel element being connected to a plurality of electrical circuits of the structure, each of the circuits receiving electrical power at the output voltage.

2. The system of claim 1 wherein the target voltage range is from approximately 100 volts to approximately 112 volts.

3. The system of claim 1 wherein the target voltage range is from approximately 104 volts to approximately 110 volts.

4. The system of claim 1 wherein the control device is configured to sense the level of the output voltage of the transformer and adjust the voltage conversion ratio of the transformer based upon the level of the output voltage of the voltage adjustment apparatus.

5. The system of claim 1 wherein the transformer comprises an autotransformer.

6. The system of claim 1 wherein the transformer comprises a buck transformer.

7. The system of claim 1 wherein the transformer is configured such that supply of electrical power is maintained to the line out when the control device fails.

8. The system of claim 1 additionally comprising a main circuit breaker element connected to the outlet of the power utilization meter for breaking connection of a potion of the main supply line to the output of the meter.

9. The system of claim 1 wherein the control device is configured to select a tap on windings of the transformer to select the voltage adjustment ratio.

10. A local voltage adjustment apparatus for connection to a power utilization meter of an electrical power utility for a structure providing electrical power at a utility supply voltage through a main supply line into the structure, the apparatus comprising:

a line in for connection to the main supply line such that electrical power on the line in has an input voltage substantially equal to the utility supply voltage;

a line out with electrical power on the line out having an output voltage for connection to multiple circuits of the structure to supply electrical power to multiple devices connected to the multiple circuits;

a transformer connected to the line in and the line out, the transformer having an adjustable voltage conversion ratio of a level of the output voltage to a level of the input voltage, the transformer comprising an autotransformer;

a control device in electrical communication with the line in to sense the level of the input voltage and in electrical communication with the line out to sense the level of the output voltage;

wherein the control device is configured to sense the level of the input voltage of the transformer and adjust the voltage conversion ratio of the transformer based upon the level of the input voltage;

wherein the control device is configured to select the voltage conversion ratio for the transformer that reduces the level of the output voltage from the level of the input voltage to a voltage in a target voltage range; and wherein the target voltage range is from approximately 100 volts to approximately 112 volts.

11. The apparatus of claim 10 wherein the target voltage range is from approximately 104 volts to approximately 110 volts.

12. The apparatus of claim 10 wherein the target voltage range is approximately 108 volts to approximately 110 volts.

13. The apparatus of claim 10 wherein the autotransformer comprises a buck transformer.

14. The apparatus of claim 10 wherein the autotransformer is configured such that supply of electrical power is maintained to the line out when the control device fails.

15. The apparatus of claim 10 wherein the control device is configured to select a tap on windings of the transformer to select the voltage adjustment ratio.

16. The system of claim 1 wherein changes in the voltage conversion ratio are based solely upon the input voltage level sensed by the control device.

17. The system of claim 1 wherein the control device is configured to continuously sense the level of the input voltage to the control device for adjustment of the voltage conversion ratio.

18. A local voltage adjustment system for a structure, comprising:

a power utilization meter for measuring power flowing through the meter from an electrical power utility at a utility supply voltage, the meter having an outlet;

a main supply line from the outlet of the meter and carrying power at the utility supply voltage;

a voltage adjustment apparatus connected to the main circuit breaker element through the main supply line, the voltage adjustment apparatus having a line in to the adjustment apparatus and a line out of the adjustment apparatus, electrical power on the line in having an input voltage substantially equal to the utility supply voltage and electrical power on the line out having an output voltage for supply to the loads of the structure, the voltage adjustment apparatus comprising:

a transformer having an adjustable voltage conversion ratio of a level of the output voltage to a level of the input voltage;

a control device in electrical communication with the line in to sense the level of the input voltage and in electrical communication with the line out to sense the level of the output voltage;

wherein the control device is configured to sense the level of the input voltage of the transformer and adjust the voltage conversion ratio of the transformer based upon the level of the input voltage, the control device being configured to select the voltage conversion ratio that reduces the level of the output voltage from the level of the input voltage to a voltage in a target voltage range; and a sub panel element connected to the line out of the voltage adjustment apparatus to receive electrical power from the apparatus at the output voltage, the sub panel element providing power to a plurality of electrical circuits of the structure at the output voltage.

* * * * *